US006200155B1

(12) United States Patent
Chudkosky et al.

(10) Patent No.: US 6,200,155 B1
(45) Date of Patent: Mar. 13, 2001

(54) UNIVERSAL POWER CORD CONNECTOR ASSEMBLY FOR AN APPLIANCE

(75) Inventors: Frank N. Chudkosky, Alexis; John C. Ellingwood, Galesburg, both of IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/370,153

(22) Filed: Aug. 9, 1999

(51) Int. Cl.[7] ..... H01R 13/62

(52) U.S. Cl. ..... 439/371; 439/373; 439/449; 174/53

(58) Field of Search ..... 439/371–373, 439/449, 456, 942, 559; 174/53, 57, 66, 67

(56) References Cited

U.S. PATENT DOCUMENTS

| | | | | |
|---|---|---|---|---|
| 3,594,693 | | 7/1971 | Robbins | 339/44 R |
| 3,652,781 | | 3/1972 | Robbins | 174/67 |
| 4,378,140 | | 3/1983 | McKee | 339/119 |
| 4,410,226 | | 10/1983 | Adduci et al. | 339/44 R |
| 4,721,476 | | 1/1988 | Zeliff et al. | 439/142 |
| 4,768,974 | | 9/1988 | Cowan et al. | 439/371 |
| 4,842,551 | | 6/1989 | Heimann | 439/502 |
| 4,861,282 | * | 8/1989 | Kobayashi et al. | 439/559 |
| 4,912,942 | * | 4/1990 | Katterhenry et al. | 439/446 |
| 4,984,982 | | 1/1991 | Brownlie et al. | 439/131 |
| 5,124,506 | | 6/1992 | Briggs et al. | 174/67 |
| 5,389,740 | | 2/1995 | Austin | 174/67 |
| 5,839,911 | | 11/1998 | Dinkel | 439/470 |
| 5,913,692 | | 6/1999 | Targett | 439/369 |

* cited by examiner

*Primary Examiner*—Hien Vu
(74) *Attorney, Agent, or Firm*—Everett G. Diederiks, Jr.

(57) ABSTRACT

An appliance is provided with an electrical connector box including a plurality of spaced tabs between which is arranged a cabinet panel portion of the appliance in order to position the connector box in an opening defined, at least in part, by the cabinet panel. The connector box further includes a socket portion in which an electrical inlet is arranged. A power cord includes a first terminal plug connected to the electrical inlet and a second terminal plug designed to fit into an electrical outlet found in a particular geographic region which the appliance is to be used. The power cord is secured in the connector box by a clamp and guided along arcuate surfaces out of the connector box, with one of the surfaces being part of a bumper member which establishes a minimum permissible distance between the appliance and a wall against which the appliance is positioned.

38 Claims, 2 Drawing Sheets

UNIVERSAL POWER CORD CONNECTOR ASSEMBLY FOR AN APPLIANCE

BACKGROUND OF THE INVENTION

1. Field of the Invention

The present invention pertains to the art of appliances and, more particularly, to a universal power cord connection assembly for use in an appliance.

2. Discussion of the Prior Art

In many cases, electrical products have to be designed and produced to specifications dependent upon the particular international market being targeted. For instance, electrical products must often be specifically produced based on the fact that electrical outlets vary between different international areas. In addition, certain products must be produced under established safety regulations. For instance, major electrical appliances, such as refrigerators, ranges, dishwashers, washing machines, clothes dryers and the like, must meet certain established safety requirements. An example of such a safety regulation is the need for major appliance power cord connections to comply with IEC 335 safety requirements.

Based on the above, manufacturers of major electrical appliances must comply with established safety requirements while attempting to minimize certain variations in the production of appliances slated for sale in different geographical regions.

SUMMARY OF THE INVENTION

The present invention is directed to an assembly for accommodating the need for various configurations of major appliance power cord plugs used in different international regions, while also complying with current safety requirements. The invention includes a molded electrical connector box which is attached to a rear panel portion of an appliance. The connector box is formed with an opening designed to receive a standard electrical inlet, preferably in a snap-fit manner. The connector box is mounted to the appliance structure in a manner which closes off any access zones to internal, hazardous electrical items of the appliance.

The connector box is preferably mounted with a minimum number of mechanical fasteners, one of which also mounts a clamp used to secure a power cord in a desired position while relieving strain in the cord. The connector box is further formed with portions for guiding sections of the power cord such that a first plug provided on one end of the cord is directed in a manner which assures a positive connection with the inlet. In accordance with the invention, the connector box arrangement can be utilized with various differently configured power cords. That is, the first end of the power cord is provided with a female plug adapted to be received in the electrical inlet, while the second end of the cord is provided with a male plug adapted to mate with an electrical outlet commonly found in the particular geographic region in which the appliance is to be sold.

In accordance with other aspects of the invention, the connector box is configured in a manner which enhances the assembly process, maximizes overall compactness, minimizes potential operational noises and directs any water away from the electrical inlet. In addition, in certain applications wherein the connector box is secured to a rear panel of an appliance adapted to be positioned adjacent a building wall during operation, the box is formed with a bumper for engaging the wall to establish an appropriate spacing.

Additional objects, features and advantages of the invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
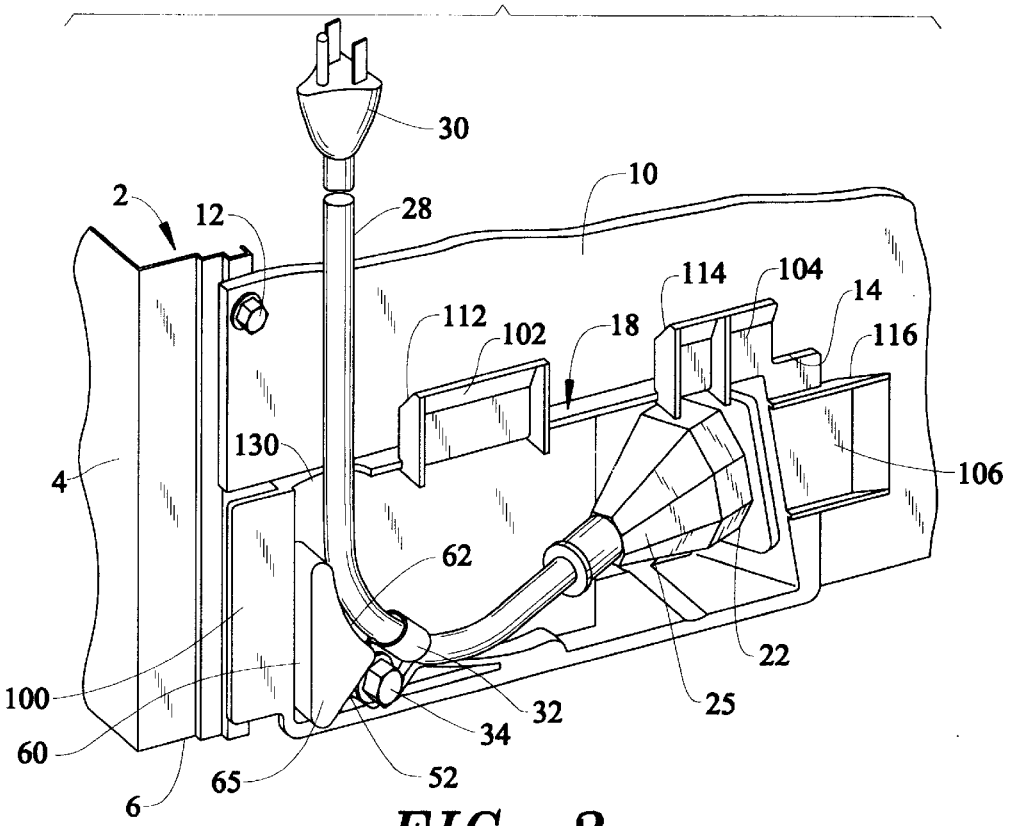
FIG. 1 is a perspective view of the universal power cord connection assembly constructed in accordance with the present invention shown attached to an appliance.

With initial reference to FIG. 1, there is shown a rear section of an appliance 2. For exemplary purposes, appliance 2 represents the back portion of a refrigerator having a side cabinet panel 4 leading to an inwardly bent rear corner portion 6. Although not shown, it should be clearly understood that a similar side cabinet panel and rear corner portion would also exist at the other side of the appliance 2. Extending across and interconnecting the rear comer portions 6 is a rear cabinet panel 10. In the case of a refrigerator, rear panel 10 constitutes a cover for a compartment typically provided to house various refrigeration components such as a compressor and fan supported on a base pan. In any event, rear panel 10 is preferably, removably connected to rear comer portions 6 through a plurality of screws, such as that indicated at 12.

In accordance with the invention, rear panel 10 is formed with a lower cut-out or opening 14 in which is positioned an electrical connector box 18. Connector box 18 is preferably molded of plastic to include a socket portion 22 into which is inserted a terminal plug 25 of a power cord 28. The opposing end of power cord 28 is also provided with a plug 30 which is configured to fit in an electrical outlet found in the particular geographic region in which appliance 2 is to be used. As further shown in this figure, power cord 28 is held in a desired position to assure a proper electrical connection within socket portion 22 by the inclusion of a P-clamp as indicated at 32. As will be detailed more fully below, clamp 32 surrounds a portion of power cord 28 adjacent plug 25 and is secured to connector box 18 through a single mechanical fastener 34.

Figure 2:
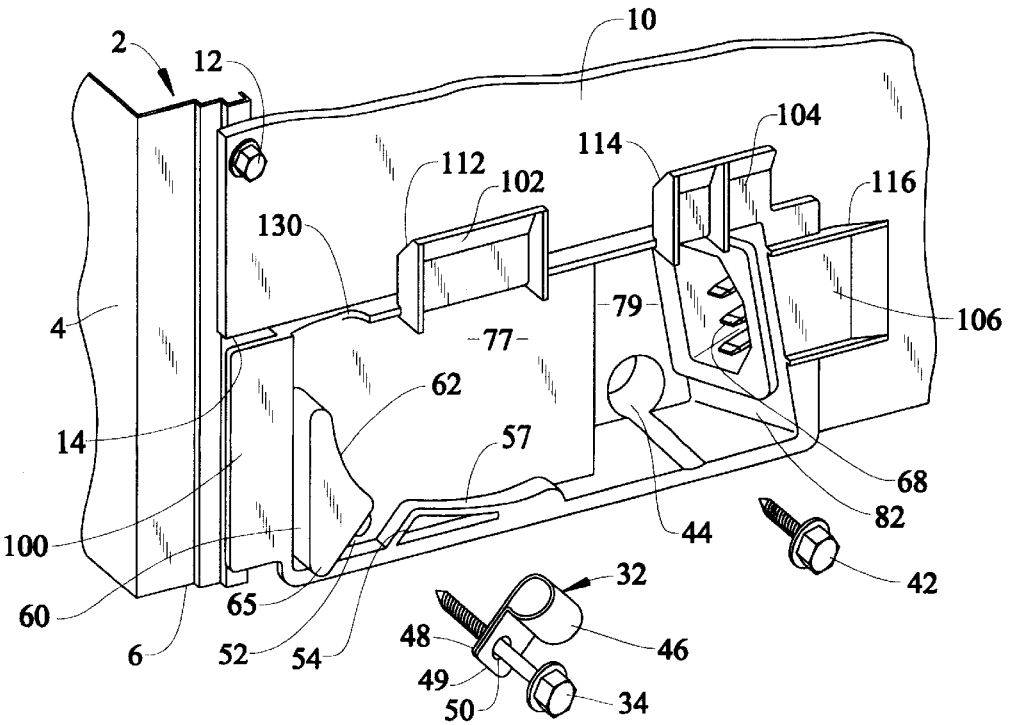
FIG. 2 is a partial exploded view of the connection assembly of FIG. 1.

FIG. 2 further illustrates that mechanical fastener 34 preferably constitutes a sheet metal screw that is used in combination with a second screw 42 to secure connector box 18 in the desired position. In the preferred embodiment, screws 34 and 42 extend through connector box 18 and into the appliance. More specifically, connector box 18 is formed with a recess 44 in order to countersink screw 42. Clamp 32 includes a loop portion 46 leading to terminal flange portions 48 and 49. Flange portions 48 and 49 are provided with aligned holes 50. With this arrangement, power cord 28 can be held in loop portion 46 and screw 42 can extend through holes 50 and connector box 18 for attachment to appliance 2. In this attachment arrangement, clamp 32 becomes positioned within a well or pocket 52 formed between a first molded cord guide 54 defining an arcuate surface 57, and a second molded cord guide 60 which is formed with an arcuate surface 62. Therefore, clamp 32 is kept from rotating by guides 54 and 60 as required by current safety standards.

Cord guide 60 is also formed with an extension 65 which projects rearwardly of appliance 2. Extension 65 is preferably provided to act as a bumper when appliance 2 is being positioned back against a wall to an inuse position. Arcuate surfaces 57 and 62 are provided, in combination with clamp 32, to support power cord 28 in a manner which minimizes strains in cord 28 and enables a positive connection of plug 25 to an inlet 68, such as an IEC 320 inlet, that is snap-fit within socket portion 22. As shown in FIGS. 1 and 2, inlet 68 and socket portion 22 are preferably arranged at a downwardly tilted angle, preferably in the range of at least five degrees, to assure that any water present in this area will easily drain away from inlet 68.

Figure 3:
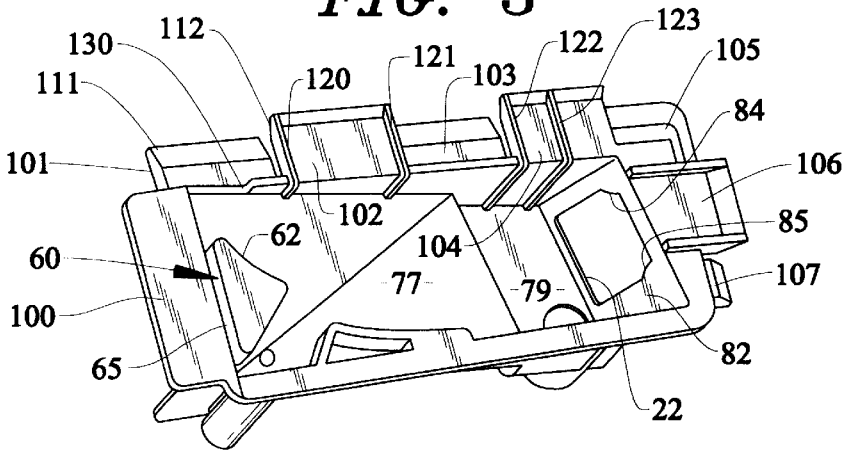
FIG. 3 is generally a left front perspective view of a connector box portion of the connection assembly.
Figure 4:
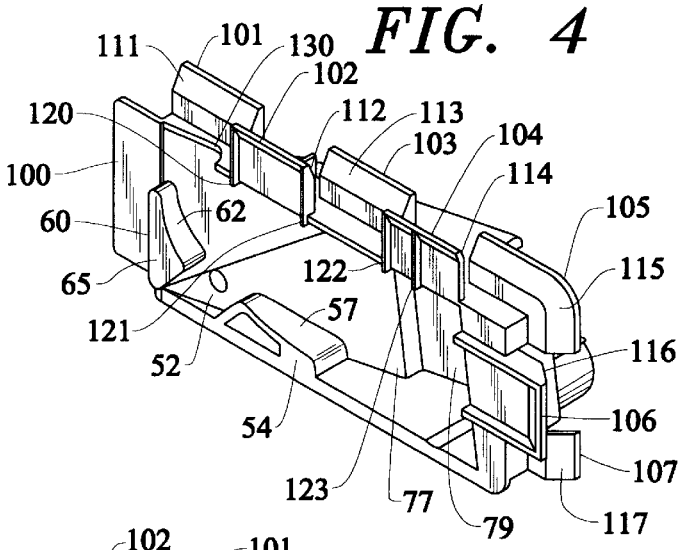
FIG. 4 is generally a upper right front perspective view of the connector box.
Figure 5:
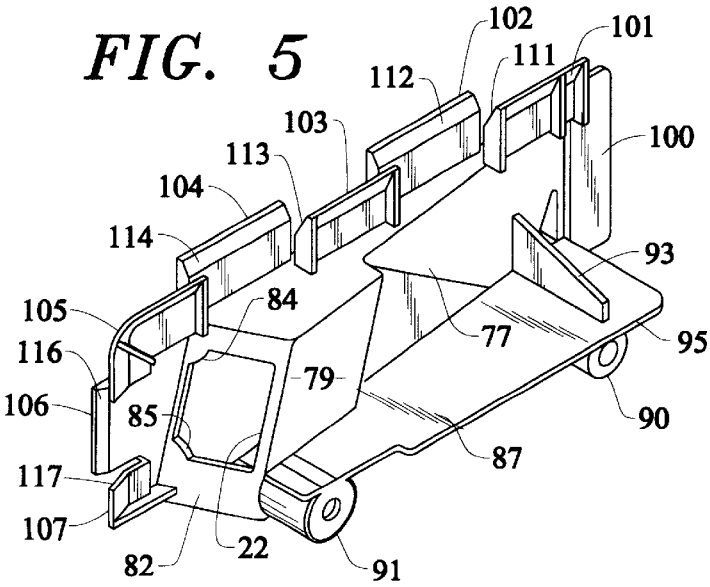
FIG. 5 is a rear perspective view of the connector box.

Further details concerning the manner in which connector box 18 is secured to appliance 2 will become more readily apparent in detailing the additional structure of box 18 with particular reference to FIGS. 3–5. Connector box 18 includes a base generally defined by a first section 77 and a second section 79. As clearly shown in these figures, connector box 18 increases in depth from first section 77 to second section 79 in order to provide ample space for the easy, preferably lateral insertion of power cord plug 25, while still maintaining a compact configuration. Socket portion 22 is formed in a wall 82 of connector box 18 and is preferably provided with corner projections 84 and 85 to assure the proper orientation of electrical inlet 68. In this position, clamp 32 prevents twisting of power cord 28 such that power cord 28 is not subjected to torsional loads and plug 25 cannot be accidentally removed.

Connector box 18 is further formed with a base extension 87 which is attached to a pair of spaced bosses 90 and 91, as well as a reinforcing rib 93. Bosses 90 and 91 receive screws 34 and 42 respectively. In the preferred embodiment wherein appliance 2 constitutes a refrigerator, at least a portion 95 of base extension 87, such as adjacent boss 90, is designed to rest on a conventional base pan to prevent rolling or shifting of the connector box 18 when only one of screws 34 and 42 is in place. This support arrangement also functions to minimize vibration noise when appliance 2 is operating.

Connector box 18 is also provided with an end flange 100 and a series of alternating, offset tabs 101–107. In general, tabs 101, 103, 105 and 107 constitute a first set of tabs which are spaced from end flange 100 and tabs 102, 104 and 106 by the thickness of rear panel 10. With this construction, connector box 18 can be mounted in one of two basic fashions depending upon the attachment sequence of rear panel 10 and connector box 18. If rear panel 10 is first attached to side panels 4 through screws 12, then connector box 18 is slipped into opening 14 with rear panel 10 being positioned between the various offset tabs 101–107 and end flange 100 abutting corner portion 6. To aid in the positioning of connector box 18, tabs 101–107 are preferably formed with respective tapered portions 111–117. In addition, various strengthening ribs, such as those shown at 120–123, are provided. In the alternative, connector box 18 can be initially attached to appliance 2 and then rear panel 10 slipped between tabs 101–107 and secured by screws 12.

With this construction, the number of mechanical fasteners needed to secure rear panel 10 (i.e., screws 12) is minimized due to the placement of tabs 101–107. In any event, connector box 18 can be easily positioned within opening 14 and attached to appliance 2 in a simple and convenient manner. As disclosed, the most preferred embodiment utilizes end flange 100, tabs 101–107 and screws 34 and 42 to assure a positive mounting of connector box 18. However, it should be understood that other attachment arrangements could also be provided, including one in which connector box 18 is snap-fit in position. In any event, electrical inlet 68 is easily mounted in socket portion 22 and the particular power cord 28, selected to have a specified plug 30 based on the particular geographic region in which appliance 2 is to be used, can be provided such that this overall arrangement generally constitutes a universal power connector system. Again, the presence of guides 54 and 60, as well as clamp 32, minimizes strains on power cord 28. Connector box 18 is also preferably formed with a cut-out portion 130 adjacent guide 60 for the routing of power cord 28 to an electrical outlet. This arrangement assures that power cord 28 is recessed relative to at least extension 65 of guide 60 such that extension 65 will abut a wall against which appliance 2 is placed and power cord 28 will not be pinched.

Although described with reference to a preferred embodiment of the invention, it should be understood that various changes and/or modifications may be made to the invention without departing from the spirit thereof. For example, although connector box 18 is disclosed as being arranged at the rear of appliance 2, it could be positioned at a side portion thereof wherein extension or bumper member 65 would be used to properly space appliance 2 from a side wall. In general, the invention is only intended to be limited by the scope of the following claims.

We claim:

1. An appliance comprising:

a cabinet panel defining at least a portion of an opening;

an electrical connector box including a socket portion and a plurality of offset tabs formed about a peripheral portion of the connector box, said connector box being positioned, at least partially, in the opening with the cabinet panel being positioned between the tabs, said connector box being formed with a bumper member adapted to abut a wall against which the appliance is to be positioned in order to assure an adequate spacing between the wall and the appliance;

an electrical inlet positioned in the socket portion of the connector box; and a power cord including first and second terminal end plugs configured to interconnect an electrical source to the electrical inlet, wherein the first plug is configured to make electrical contact with the electrical inlet and the second plug is designed to fit into an electrical outlet found in a particular geographic region which the appliance is to be used.

2. The appliance according to claim 1, further comprising: at least one internal surface provided in the connector box for guiding the power cord out of the connector box.

3. The appliance according to claim 2, wherein the connector box includes multiple, arcuate internal surfaces for guiding the power cord out of the connector box.

4. The appliance according to claim 1, wherein at least certain of the plurality of tabs include tapered surfaces for aiding in receiving the cabinet panel.

5. An appliance comprising:

a cabinet panel defining at least a portion of an opening;

an electrical connector box positioned, at least partially, in the opening, said connector box including a socket portion and multiple, arcuate internal surfaces;

an electrical inlet positioned in the socket portion; and a power cord including first and second terminal end plugs, wherein the first plug is configured to make electrical contact with the electrical inlet, the power cord is guided out of the connector box by the multiple, arcuate internal surfaces, and the second plug is designed to fit into an electrical outlet found in a particular geographic region which the appliance is to be used.

6. The appliance according to claim 5, wherein the connector box includes a housing having a recessed body portion, said electrical inlet opening into the recessed body portion such that the first plug is adapted to be positioned substantially entirely within the connector box.

7. The appliance according to claim 6, wherein the cabinet panel constitutes a rear panel extending between laterally spaced side cabinet panels, with the first plug extending into the socket portion in a lateral direction.

8. The appliance according to claim 5, wherein at least one of the internal surfaces further constitutes a bumper member adapted to abut a wall against which the appliance is to be positioned in order to assure an adequate spacing between the wall and the appliance.

9. The appliance according to claim 5, wherein the connector box includes a bumper member adapted to abut a wall against which the appliance is to be positioned in order to assure an adequate spacing between the wall and the appliance.

10. The appliance according to claim 5, further comprising: a plurality of offset tabs formed as part of the connector box, said connector box being positioned in the opening with the cabinet panel being positioned between the tabs.

11. The appliance according to claim 10, wherein at least certain of the plurality of tabs include tapered surfaces for aiding in receiving the cabinet panel.

12. The appliance according to claim 5, further comprising: a clamp for securing the power cord to the connector box.

13. The appliance according to claim 12, wherein the connector box is formed with a pocket, with the clamp being substantially, non-rotatably seated within the pocket.

14. The appliance according to claim 5, wherein the electrical inlet is arranged at a downwardly tilted angle.

15. An appliance comprising:

a cabinet panel defining at least a portion of an opening;

an electrical connector box including a plurality of offset tabs formed about a peripheral portion of the connector box, said connector box being positioned, at least partially, in the opening with the cabinet panel being positioned between the tabs, wherein at least certain of the plurality of tabs include tapered surfaces for aiding in receiving the cabinet panel;

an electrical inlet positioned in the connector box; and a power cord including first and second terminal end plugs configured to interconnect an electrical source to the electrical inlet.

16. The appliance according to claim 14, wherein the first plug is configured to make electrical contact with the electrical inlet and the second plug is designed to fit into an electrical outlet found in a particular geographic region which the appliance is to be used.

17. The appliance according to claim 16, wherein the connector box includes a housing having a recessed body portion, said electrical inlet opening into the recessed body portion such that the first plug is adapted to be positioned substantially entirely within the connector box.

18. The appliance according to claim 17, wherein the cabinet panel constitutes a rear panel extending between laterally spaced side cabinet panels and the connector box includes a socket portion, said first plug extending into the socket portion in a lateral direction.

19. The appliance according to claim 14, further comprising: at least one internal surface provided in the connector box for guiding the power cord out of the connector box.

20. The appliance according to claim 19, wherein the connector box includes multiple, arcuate internal surfaces for guiding the power cord out of the connector box.

21. The appliance according to claim 19, wherein the at least one internal surface further constitutes a bumper member adapted to abut a wall against which the appliance is to be positioned in order to assure an adequate spacing between the wall and the appliance.

22. The appliance according to claim 14, wherein the connector box includes a bumper member adapted to abut a wall against which the appliance is to be positioned in order to assure an adequate spacing between the wall and the appliance.

23. The appliance according to claim 14, further comprising: a clamp for securing the power cord to the connector box.

24. The appliance according to claim 23, wherein the connector box is formed with a pocket, with the clamp being substantially, non-rotatably seated within the pocket.

25. The appliance according to claim 14, wherein the electrical inlet is arranged at a downwardly, tilted angle.

26. An appliance comprising:

a cabinet panel defining at least a portion of an opening;

an electrical connector box including a housing having a recessed body portion, said electrical connector box being positioned, at least partially, in the opening, said connector box being integrally formed with a bumper member adapted to abut a wall against which the appliance is to be positioned in order to assure an adequate spacing between the wall and the appliance and;

an electrical inlet positioned in the connector box, said electrical inlet being exposed within the recessed body portion, said bumper member projecting from the housing in a direction away from the cabinet panel and beyond the electrical inlet.

27. The appliance according to claim 26, further comprising: a power cord including first and second terminal end plugs configured to interconnect an electrical source to the electrical inlet.

28. The appliance according to claim 27, wherein the connector box includes a socket portion, said electrical inlet being positioned in the socket portion.

29. The appliance according to claim 28, wherein the first plug is adapted to be positioned substantially entirely within the connector box.

30. The appliance according to claim 29, wherein the cabinet panel constitutes a rear panel extending between laterally spaced side panels, with the first plug extending into the socket portion in a lateral direction.

31. The appliance according to claim 28, wherein the electrical inlet is arranged at a downwardly, tilted angle.

32. The appliance according to claim 26, further comprising: at least one internal surface provided in the connector box for guiding the power cord out of the connector box.

33. The appliance according to claim 32, wherein the connector box includes multiple, arcuate internal surfaces for guiding the power cord out of the connector box.

34. The appliance according to claim 32, wherein the bumper member includes the at least one internal surface.

35. The appliance according to claim 26, further comprising: a plurality of offset tabs formed as part of the connector box, said connector box being positioned in the opening with the cabinet panel being positioned between the tabs.

36. The appliance according to claim 35, wherein at least certain of the plurality of tabs include tapered surfaces for aiding in receiving the cabinet panel.

37. The appliance according to claim 26, further comprising: a clamp for securing the power cord to the connector box.

38. The appliance according to claim 37, wherein the connector box is formed with a pocket, with the clamp being substantially, non-rotatably seated within the pocket.

* * * * *